US007166566B2

(12) United States Patent
Mangin et al.

(10) Patent No.: US 7,166,566 B2
(45) Date of Patent: Jan. 23, 2007

(54) KIT OF WATER-SOLUBLE OR WATER DISPERSIBLE POUCHES

(75) Inventors: Raphael Louis Mangin, Brussels (BE); Tom Jozef Pieter Goderis, Ghent (BE)

(73) Assignee: The Procter & Gamble Company, Cincinnati, OH (US)

( * ) Notice: Subject to any disclaimer, the term of this patent is extended or adjusted under 35 U.S.C. 154(b) by 260 days.

(21) Appl. No.: 10/141,332

(22) Filed: May 8, 2002

(65) Prior Publication Data

US 2003/0069155 A1 Apr. 10, 2003

(30) Foreign Application Priority Data

May 8, 2001 (EP) ..... 01870097

(51) Int. Cl.
*C11D 17/04* (2006.01)
*C11D 3/50* (2006.01)
*B08B 9/20* (2006.01)

(52) U.S. Cl. ..... 510/439; 510/108; 510/220; 510/296; 510/406; 134/25.2

(58) Field of Classification Search ..... 510/439, 510/120, 277, 406, 220, 108, 296; 134/25.2
See application file for complete search history.

(56) References Cited

U.S. PATENT DOCUMENTS

| | | | | |
|---|---|---|---|---|
| 4,522,738 | A | 6/1985 | Magid et al. | 510/100 |
| 4,973,416 | A | 11/1990 | Kennedy | 510/296 |
| 5,132,036 | A | 7/1992 | Falou et al. | |
| 5,160,654 | A | 11/1992 | Falou et al. | |
| 5,224,601 | A * | 7/1993 | Gouge et al. | 206/524.7 |
| 6,426,089 | B1 * | 7/2002 | Sunohara et al. | 424/451 |
| 6,448,212 | B1 | 9/2002 | Holderbaum et al. | |
| 6,484,879 | B1 * | 11/2002 | Desmarais et al. | 206/524.7 |
| 6,624,130 | B1 * | 9/2003 | Giblin et al. | 510/297 |
| 6,727,215 | B1 * | 4/2004 | Roberts et al. | 510/296 |
| 6,831,051 | B1 * | 12/2004 | Sommerville-Roberts et al. | 510/296 |
| 6,878,679 | B1 | 4/2005 | Sommerville-Roberts et al. | |
| 6,881,713 | B1 | 4/2005 | Sommerville-Roberts et al. | |
| 2001/0031714 | A1 | 10/2001 | Gassenmeier et al. | |
| 2002/0169092 | A1 * | 11/2002 | Catlin et al. | 510/220 |
| 2003/0050210 | A1 | 3/2003 | Pounds et al. | |
| 2005/0003992 | A1 | 1/2005 | Del Duca et al. | |
| 2005/0267005 | A1 | 12/2005 | Dasque et al. | |

FOREIGN PATENT DOCUMENTS

| | | | |
|---|---|---|---|
| DE | 195 21 140 | A1 | 12/1996 |
| EP | 0 414 462 | A2 | 2/1991 |
| EP | 0 593 952 | A1 | 4/1994 |
| EP | 879874 | A2 | 11/1998 |
| EP | 1 126 070 | A1 | 8/2001 |
| EP | 0879874 | | 12/2003 |
| JP | 63-8497 | | 1/1988 |
| JP | 06056158 | | 3/1994 |
| WO | WO/0129172 | A1 | 4/2001 |

OTHER PUBLICATIONS

Masao Fujimaki, Tatsuhiko Hattori, Kazuo Hayashi, Souichi Arai, Dictionary of Perfumes, Aug. 27, 1980, pp. 1-5, Publisher - Asakura, Kunizo, Tokyo, Japan.

* cited by examiner

*Primary Examiner*—Lorna M. Douyon
(74) *Attorney, Agent, or Firm*—Jason J. Camp; Jeffrey V. Bamber; Laura R. Grunzinger

(57) ABSTRACT

The present invention relates to a kit comprising at least a first and a second water-soluble or water-dispersible pouch containing at least a first and a second composition, each composition comprising at least one different ingredient.

15 Claims, No Drawings

KIT OF WATER-SOLUBLE OR WATER DISPERSIBLE POUCHES

TECHNICAL FIELD

The present invention relates to a kit comprising at least a first and a second water-soluble or water-dispersible pouch containing a composition, preferably a dishwashing composition. Said first and second pouch or composition comprised therein providing a different visual effect or comprising at least one different ingredient.

BACKGROUND

Water-soluble or water-dispersible pouches are known in the prior art. Such pouches have been described as a method of packaging laundry detergent since the 1980s. Such pouches are generally understood to provide a convenient method of allowing the user to handle the detergent product without having to directly handle chemicals, especially hazardous or irritable chemicals.

EP 879 874 describes pouches comprising hard surface cleaning compositions, including hand dishwashing compositions. Such pouches are described to provide the similar benefits as pouches provided to the laundry detergent industry, namely convenience and ease of handling.

The Applicants have however found that while consumers welcome pouches for the above reasons of convenience, given the choice they would prefer to be able to vary the product used depending on the nature or severity of the job, the character or mood of the user. The present invention thus provides a kit of dishwashing pouches, comprising at least 2 pouches, each pouch providing a different visual effect or comprising a different composition. Said composition may differ in the perfume, dye or active ingredients as described in detail below.

It is further envisaged that the kit of the present invention may equally be applied to other hard surface cleaning or laundry applications.

SUMMARY OF THE INVENTION

According to the present invention there is provided a kit comprising at least a first and a second water-soluble or water-dispersible pouch containing at least a first and a second composition, each pouch or composition comprised therein providing a different visual effect or comprising at least one different ingredient.

DETAILED DESCRIPTION OF THE INVENTION

The kit of the present invention comprises at least two pouches, said pouches comprising compositions. The kit comprises at least a first type of pouch comprising a first type of composition and a second type of pouch comprising a second type of composition. In a preferred embodiment the kit comprises a first and second type of pouch and composition and a third, optionally fourth and optionally further types of pouch and composition. Each pouch or composition contained therein providing a different visual effect or comprising at least one different ingredient. By the term 'visual effect' it is meant the visual appearance of the pouch or composition noticeable by the human eye. By 'pouch or compositions comprising at least one different ingredient' it is meant herein that the pouch composition contained within the pouch may be substantially identical but differ by the presence of at least one ingredient in the first pouch or composition that is not present in the second pouch or composition or vice versa. In a preferred aspect of the present invention the first and second and optionally third, fourth and further pouches or compositions each comprise at least one ingredient that is not present in each of the other pouches or compositions. More preferably the pouches are all identical and the compositions provide the different visual effect or chemically different composition.

The difference in visual effect may be achieved by varying for example the shape, size, texture of the pouch. Alternatively the difference in visual effect may be achieved by varying the colour, transparency, form of the compositions. The composition may be dyed to any preferred colour depending on the presence of colourant in the composition. The composition may be more or less transparent depending on the formulation, for example the composition may be opaque or transparent or any degree of transparency in between. The composition may be in solid, liquid, gel, paste form or mixtures thereof. For example the compositions may be liquid and one may comprise suspended solid particles. Said suspended solid particles may be any size, shape or colour as is required. In one embodiment the compositions all comprise suspended solids in a liquid matrix and the compositions differ in the colour or size of the suspended solids. Alternatively one composition may be in the form of a homogeneous substantially transparent liquid, whilst the other is in the form of a substantially opaque emulsion.

The kit preferably comprises sufficient pouches of the first type and second type to provide a months supply of detergent product. More preferably the kit comprises at least 7 to 15 pouches, more preferably a mixture of at least the first pouches, comprising the first composition and the second pouches comprising the second composition. More preferably the kit comprises first, second, third and fourth pouches and compositions.

Pouch

The pouch of the invention, herein referred to as "pouch", is typically a closed structure, made of a water-soluble or water-dispersible film described herein, enclosing a volume space which comprises a composition. Said composition is described in more detail herein. The pouch can be of any form, shape and material which is suitable to hold the composition, e.g. without allowing the release of the composition from the pouch prior to contact of the pouch with water. The exact execution will depend on for example, the type and amount of the composition in the pouch, the number of compartments in the pouch, the characteristics required from the pouch to hold, protect and deliver or release the composition.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the washing load.

It may be preferred that the water-soluble or water-dispersible film and preferably the pouch as a whole is stretched during formation and/or closing of the pouch, such that the resulting pouch is at least partially stretched. This is to reduce the amount of film required to enclose the volume space of the pouch. When the film is stretched the film thickness decreases. The degree of stretching indicates the amount of stretching of the film by the reduction in the thickness of the film. For example, if by stretching the film, the thickness of the film is exactly halved then the stretch degree of the stretched film is 100%. Also, if the film is stretched so that the film thickness of the stretched film is exactly a quarter of the thickness of the unstretched film then the stretch degree is exactly 200%. Typically and preferably, the thickness and hence the degree of stretching is non-uniform over the pouch, due to the formation and closing process. For example, when a water-soluble or water-dispersible film is positioned in a mould and an open compartment is formed by vacuum forming (and then filled with the components of a composition and then closed), the part of the film in the bottom of the mould, furthest removed from the points of closing will be stretched more than in the top part. Preferably, the film which is furthest away from the opening, e.g. the film in the bottom of the mould, will be stretched more and be thinner than the film closest by the opening, e.g. at the top part of the mould.

Another advantage of stretching the pouch, is that the stretching action, when forming the shape of the pouch and/or when closing the pouch, stretches the pouch non-uniformly, which results in a pouch which has a non-uniform thickness. This allows control of the dissolution of water-soluble pouches herein, and for example sequential release of the components of the detergent composition enclosed by the pouch to the water.

Preferably, the pouch is stretched such that the thickness variation in the pouch formed of the stretched film is from 10 to 1000%, preferably 20% to 600%, or even 40% to 500% or even 60% to 400%. This can be measured by any method, for example by use of an appropriate micrometer. Preferably the pouch is made from a water-soluble film that is stretched, said film has a stretch degree of from 40% to 500%, preferably from 40% to 200%.

The pouch is made from a water-soluble or water-dispersible film. It is preferred that the pouch as a whole comprises material which is water-dispersible or more preferably water-soluble. Preferred water-soluble films are polymeric materials, preferably polymers which are formed into a film or sheet. The material in the form of a film can for example be obtained by casting, blow-moulding, extrusion or blow extrusion of the polymer material, as known in the art.

Preferred water-dispersible material herein has a dispersability of at least 50%, preferably at least 75% or even at least 95%, as measured by the method set out hereinafter using a glass-filter with a maximum pore size of 50 microns.

More preferably the material is water-soluble and has a solubility of at least 50%, preferably at least 75% or even at least 95%, as measured by the method set out hereinafter using a glass-filter with a maximum pore size of 50 microns, namely:

Gravimetric method for determining water-solubility or water-dispersability of the material of the compartment and/or pouch:

50 grams±0.1 gram of material is added in a 400 ml beaker, the weight of which has been determined, and 245 ml±1 ml of distilled water is added. This is stirred vigorously with a magnetic stirrer set at 600 rpm, for 30 minutes. Then, the mixture is filtered through a folded qualitative sintered-glass filter with pore size as defined above (max. 50 micron). The water is dried off from the collected filtrate by any conventional method, and the weight of the remaining polymer is determined (which is the dissolved or dispersed fraction). Then, the % solubility or dispersability can be calculated.

Preferred polymers, copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). Preferably, the level of a type polymer (e.g., commercial mixture) in the film material, for example PVA polymer, is at least 60% by weight of the film.

The polymer can have any weight average molecular weight, preferably from about 1000 to 1,000,000, or even from 10,000 to 300,000 or even from 15,000 to 200,000 or even from 20,000 to 150,000.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising a hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-dispersible, or water-soluble.

It may be preferred that the polymer present in the film is from 60–98% hydrolysed, preferably 80% to 90%, to improve the dissolution of the material.

Most preferred are films which are water-soluble and stretchable films, as described above. Highly preferred water-soluble films are films which comprise PVA polymers and that have similar properties to the film known under the trade reference M8630, as sold by Chris-Craft Industrial Products of Gary, Ind., U.S.

The water-soluble film herein may comprise other additive ingredients than the polymer or polymer material. For example, it may be beneficial to add plasticisers, for example glycerol, ethylene glycol, diethyleneglycol, propylene glycol, sorbitol and mixtures thereof, additional water, disintegrating aids. It may be useful that the pouch or water-soluble film itself comprises a detergent additive to be delivered to the wash water.

The pouch is made by a process comprising the steps of contacting a composition herein to a water-soluble film in such a way as to partially enclose said composition to obtain a partially formed pouch, optionally contacting said partially formed pouch with a second water-soluble film, and then sealing said partially formed pouch to obtain a pouch.

Preferably, the pouch is made using a mould, preferably the mould has rounded inner side walls and rounded inner bottom wall. A water-soluble film may be vacuum pulled into the mould so that said film is flush with the inner walls of the mould. A composition herein may then be poured into the mould, a second water-soluble film may be placed over the mould with the composition and the pouch may then be sealed, preferably the partially formed pouch is heat sealed. The film is preferably stretched during the formation of the pouch.

The pouches of the present invention comprises from 1 to 50 mL, more preferably from 1 to 30 mL, more preferably from 1 to 20 mL and most preferably from 2 to 10 mL of composition.

Composition

The compositions of the present invention may comprise ingredients selected from the group consisting of hydrotrope, viscosity modifier, diamine, surfactants, polymeric suds stabiliser, enzymes, builder, oxygen bleach, bleach activator, bleach catalyst, perfume, solvent, colourants, chelating agent, soil release polymers, polymeric dispersants, polysaccharides, abrasives, bactericides and other antimicrobials, tarnish inhibitors, buffers, antifungal or mildew control agents, insect repellents, processing aids, suds boosters, brighteners, anti-corrosive aids, stabilizers, antioxidants and mixtures thereof. More preferably the composition comprise ingredients selected from the group consisting of perfume, dye and mixtures thereof.

All parts, percentages and ratios used herein are expressed as percent weight unless otherwise specified. All documents cited are, in relevant part, incorporated herein by reference.

The compositions may be aqueous or non-aqueous. Where the compositions are aqueous they preferably comprise less than 15% water, more preferably less than 12% water, more preferably less than 8% water and most preferably less than 6% water.

The composition may be prepared for specific dishwashing tasks. For example a tough food cleaning unit dose detergent may preferably comprise ingredients selected from solvents, builders, chelants, abrasives, enzymes, anionic surfactants and mixtures thereof. Compositions for glass cleaning preferably comprise ingredients selected from builders, chelants, solvents, sheeting nonionic surfactants and mixtures thereof. Compositions conferring a mildness benefit on the user may preferably comprise protease enzymes. Compositions for cleaning specific stains, especially highly coloured stains for example tea, coffee, wine, tomato-based stains, preferably comprise ingredients selected from stabilised oxygen bleach, bleach activator, catalysts and mixtures thereof.

Perfumes

In a preferred aspect of the present invention the compositions comprise a perfume. In a particularly preferred embodiment the compositions comprise different perfumes such that the user will gain a different olfactory experience with each different type of pouch.

In a particularly preferred embodiment the compositions comprise a blooming perfume. A blooming perfume composition is one which comprises blooming perfume ingredients. A blooming perfume ingredient may be characterized by its boiling point (B.P.) and its octanol/water partition coefficient (P). B.P. according to the present invention is measured under normal standard pressure of 760 mmHg. The boiling points of many perfume ingredients, at standard 760 mm Hg are given in, e.g., "Perfume and Flavor Chemicals (Aroma Chemicals)," Steffen Arctander, published by the author, 1969, incorporated herein by reference.

The octanol/water partition coefficient of a perfume ingredient is the ratio between its equilibrium concentrations in octanol and in water. The partition coefficients of the preferred perfume ingredients of the present invention may be more conveniently given in the form of their logarithm to the base 10, logP. The logP values of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

In a preferred aspect of the present invention the perfume composition comprising at least two perfume ingredients. The first perfume ingredient is characterised by having boiling point of 250° C. or less and ClogP of 3.0 or less. More preferably the first perfume ingredient has boiling point of 240° C. or less, most preferably 235° C. or less. More preferably the first perfume ingredient has a ClogP value of less than 3.0, more preferably 2.5 or less. The first perfume ingredient is present at a level of at least 7.5% by weight of the composition, more preferably at least 8.5% and most preferably at least 9.5% by weight of the composition.

The second perfume ingredient is characterised by having boiling point of 250° C. or less and ClogP of 3.0 or more. More preferably the second perfume ingredient has boiling point of 240° C. or less, most preferably 235° C. or less. More preferably the second perfume ingredient has a ClogP value of greater than 3.0, even more preferably greater than 3.2. The second perfume ingredient is present at a level of at least 35% by weight of the composition, more preferably at least 37.5% and most preferably greater than 40% by weight of the perfume composition.

More preferably the perfume composition may comprise a plurality of ingredients chosen from the first group of perfume ingredients and a plurality of ingredients chosen from the second group of perfume ingredients. In addition to the above, it is also preferred that the composition comprise at least one perfume ingredient selected from either first and/or second perfume ingredients which is present in an amount of at least 7% by weight of the perfume composition, preferably at least 8.5% of the perfume composition, and most preferably, at least 10% of the perfume composition.

The first and second perfume ingredients are preferably selected from the group consisting of esters, ketones, aldehydes, alcohols, derivatives thereof and mixtures thereof. Preferred examples of the first and second perfume ingredients can be found in PCT application number US00/19078 (Applicants case number CM2396F).

In the perfume art, some auxiliary materials having no odor, or a low odor, are used, e.g., as solvents, diluents, extenders or fixatives. Non-limiting examples of these materials are ethyl alcohol, carbitol, diethylene glycol, dipropylene glycol, diethyl phthalate, triethyl citrate, isopropyl myristate, and benzyl benzoate. These materials are used for, e.g., solubilizing or diluting some solid or viscous perfume ingredients to, e.g., improve handling and/or formulating. These materials are useful in the blooming perfume compositions, but are not counted in the calculation of the limits for the definition/formulation of the blooming perfume compositions of the present invention.

It can be desirable to use blooming and delayed blooming perfume ingredients and even other ingredients, preferably in small amounts, in the blooming perfume compositions of the present invention, that have low odor detection threshold values. The odor detection threshold of an odorous material is the lowest vapor concentration of that material which can be detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of non-blooming perfume ingredients that have low odor detection threshold values can improve perfume odor character, without the potential negatives normally associated with such ingredients, e.g., spotting and/or filming on, e.g., dish surfaces. Non-limiting examples of perfume ingredients that have low odor detection threshold values useful in the present invention include coumarin, vanillin, ethyl vanillin, methyl dihydro isojasmonate, 3-hexenyl salicylate, isoeugenol, lyral, gamma-undecalactone, gamma-dodecalactone, methyl beta naphthyl ketone, and mixtures thereof. These materials are preferably present at low levels in addition to the blooming and optionally delayed blooming ingredients, typically less than 5%, preferably less than 3%, more preferably less than 2%, by weight of the blooming perfume compositions of the present invention.

The perfumes suitable for use in the cleaning compositions herein can be formulated from known fragrance ingredients and for purposes of enhancing environmental compatibility, the perfume compositions used herein are preferably substantially free of halogenated fragrance materials and nitromusks.

Alternatively the perfume ingredients of the present invention or a portion thereof may be complexed with a complexing agent. Complexing agents may include any compound which encapsulate or bind perfume raw materials in aqueous solution. Binding can result from one or more of strong reversible chemical bonding, reversible weak chemical bonding, weak or strong physical absorption or adsorption and, for example, may take the form of encapsulation, partial encapsulation, or binding. Complexes formed can be 1:1, 1:2, 2:1 complexant:perfume ratios, or can be more complex combinations. It is also possible to bind perfumes via physical encapsulation via coating (e.g. starch coating), or coacervation. Key to effective complexation for controlled perfume release is an effective de-complexation mechanism, driven by use of the product for washing dishes or hard surfaces. Suitable de-complexation mechanisms can include dilution in water, increased or decreased temperature, increased or decreased ionic strength. It is also possible to chemically or physically decompose a coated perfume, eg via reaction with enzyme, bleach or alkalinity, or via solubilization by surfactants or solvents. Preferred complexing agents include cyclodextrin, zeolites, coacervates starch coatings, and mixtures thereof.

Cyclodextrin molecules are known for their ability to form complexes with perfume ingredients and have typically been taught as a perfume carrier. In addition, cyclodextrin molecules also appear to be surprisingly effective at reducing malodors generated by nitrogenous compounds, such as amines.

The prior art teaches the use of drier-added fabric softener sheets containing high levels of cyclodextrin/perfume complexes wherein the fabrics treated with this solid cyclodextrin complex release perfume when the fabrics are rewetted and that these cyclodextrin/perfume complexes can be used in aqueous rinse-added fabric softener compositions without being protected. By "protected" it is meant that the cyclodextrin is encapsulated in a hydrophobic wax coating so the cyclodextrin/perfume complexes will not decompose due to the presence of water. See e.g. U.S. Pat. No. 5,578,563, issued Nov. 26, 1996, to Trinh et al., which is hereby incorporated by reference. Thus the cyclodextrin used in the present invention may either be "unprotected", as discussed above, or "protected" by the hydrophobic-coating protection techniques discussed in the prior art; see e.g. U.S. Pat. No. 5,102,564 to Gardlik et al., issued Apr. 7, 1992; U.S. Pat. No. 5,234,610, to Gardlik et al., issued Aug. 10, 1993.

The cavity of a cyclodextrin molecule has a substantially conical shape. It is preferable in the present invention that the cone-shaped cavity of the cyclodextrins have a length (altitude) of 8 Å and a base size of from 5 Å to 8.5 Å. Thus the preferred cavity volume for cyclodextrins of the present invention is from 65 $Å^3$ to 210 $Å^3$.

Suitable cyclodextrin species include any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in a donut-shaped ring. The specific coupling and conformation of the glucose units give the cyclodextrins a rigid, conical molecular structure with a hollow interior of a specific volume. The "lining" of the internal cavity is formed by hydrogen atoms and glycosidic bridging oxygen atoms, therefore this surface is fairly hydrophobic. The unique shape and physical-chemical property of the cavity enable the cyclodextrin molecules to absorb (form inclusion complexes with) organic molecules or parts of organic molecules which can fit into the cavity. Many perfume molecules can fit into the cavity.

The cyclodextrin molecules are preferably water-soluble. The water-soluble cyclodextrins used herein preferably have a water solubility of at least 10 g in 100 ml water, more preferably at least 25 g in 100 ml of water at standard temperature and pressure. Examples of preferred water-soluble cyclodextrin derivative species suitable for use herein are hydroxypropyl alpha-cyclodextrin, methylareal alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from 1 to 14, more preferably from 1.5 to 7, wherein the total number of OR groups per cyclodextrin is defined as the degree of substitution. Methylated cyclodextrin derivatives typically have a degree of substitution of from 1 to 18, preferably from 3 to 16. A known methylated beta-cyclodextrin is heptakis-2,6-di-O-methyl-.beta.-cyclodextrin, commonly known as DIMEB, in which each glucose unit has 2 methyl groups with a degree of substitution of 14. A preferred, more commercially available methylated beta-cyclodextrin is a randomly methylated beta-cyclodextrin having a degree of substitution of 12.6. The preferred cyclodextrins are available, e.g., from American Maize-Products Company and Wacker Chemicals (USA), Inc.

Further cyclodextrin species suitable for use in the present invention include alpha-cyclodextrin and derivatives thereof, gamma-cyclodextrin and derivatives thereof, derivatised beta-cyclodextrins, and/or mixtures thereof. Other derivatives of cyclodextrin which are suitable for use in the present invention are discussed in U.S. Pat. No. 5,578,563, incorporated above. It should be noted that two or more different species of cyclodextrin may be used in the same liquid detergent composition.

The complexes may be formed in any of the ways known in the art. Typically, the complexes are formed either by bringing the fragrance materials and the cyclodextrin together in a suitable solvent e.g. water and ethanol mixtures, propylene glycol. Additional examples of suitable processes as well as further preferred processing parameters and conditions are disclosed in U.S. Pat. No.,5,234,610, to Gardlik et al., issued Aug. 10, 1993, which is hereby incorporated by reference. After the cyclodextrin and fragrance materials are mixed together, this mixture is added to the liquid detergent composition.

Generally, only a portion (not all) of the fragrance materials mixed with the cyclodextrin will be encapsulated by the cyclodextrin and form part of the cyclodextrin/perfume complex; the remaining fragrance materials will be free of the cyclodextrin and when the cyclodextrin/perfume mixture is added to the detergent composition they will enter the detergent composition as free perfume molecules. A portion of free cyclodextrin molecules which are not complexed with the fragrance materials may also be present. In an alternative embodiment of the present invention, the fragrance materials and cyclodextrins are added uncomplexed and separately to the liquid detergent compositions. Consequently, the cyclodextirns and fragrance materials will come into the presence of each other in the composition, and a portion of each will combine to form the desired fragrance materials/cyclodextrin complex.

Suitable fragrance materials for use in the present invention are described in greater detail below.

In general, perfume/cyclodextrin complexes have a molar ratio of perfume compound to cyclodextrin of 1:1. However, the molar ratio can be either higher or lower, depending on the size of the perfume compound and the identity of the cyclodextrin compound. In the present invention the molar ratio of fragrance materials to cyclodextrin is preferably from 4:1 to 1:4, more preferably from 1.5:1 to 1:2, most preferably from 1:1 to 1:1.5. The molar ratio can be determined easily by forming a saturated solution of the cyclodextrin and adding the perfume to form the complex. In general the complex will precipitate readily. If not, the complex can usually be precipitated by the addition of electrolyte, change of pH, cooling, etc. The complex can then be analyzed to determine the ratio of perfume to cyclodextrin.

The actual complexes are determined by the size of the cavity in the cyclodextrin and the size of the perfume molecule. Although the normal complex is one molecule of perfume in one molecule of cyclodextrin, complexes can be formed between one molecule of perfume and two molecules of cyclodextrin when the perfume molecule is large and contains two portions that can fit in the cyclodextrin. Highly desirable complexes can be formed using mixtures of cyclodextrins since perfumes are normally mixtures of materials that vary widely in size. It is usually desirable that at least a majority of the material be beta- and/or gamma-cyclodextrin. It is highly desirable to use the reaction mixtures from the intermediate stages of the manufacture of the pure cyclodextrins as discussed hereinbefore.

Perfume Examples

The following examples numbered A to H, of the preferred perfume composition are in no way meant to be limiting.

| Perfume ingredient | A | B | C | D | E | F | G | H |
|---|---|---|---|---|---|---|---|---|
| Allyl Caproate | 2 | — | — | 4 | — | 2 | — | 3 |
| Citronellyl Acetate | 5 | 8 | 6 | 3 | 5 | 6 | 5 | 3 |
| Delta Damascone | 1 | 0.5 | 0.9 | 3 | 0.8 | 2 | 0.6 | 1 |
| Ethyl-2-methyl Butyrate | 8 | 2 | 1.5 | 12 | 1.5 | 15 | 1 | 11 |
| Flor Acetate | 8 | — | — | 4 | — | 4 | — | 5 |
| Frutene | 4 | — | — | 8 | — | 4 | — | 8 |
| Geranyl Nitrile | 1 | 15 | 22 | 1 | 28 | 1 | 32 | 5 |
| Ligustral | 6 | 7.5 | 12 | 10 | 8 | 13 | 8 | 10 |
| Methyl dihydro Jasmonate | 27.69 | 37.36 | 21.89 | 25 | 28.04 | 30 | 25.70 | 25.59 |
| Nectaryl | 5 | — | — | 3 | — | 4 | — | 3 |
| Neobutanone | 0.30 | 0.09 | 0.12 | 0.3 | 0.1 | 0.2 | 0.15 | 0.4 |
| Oxane | 0.01 | 0.05 | 0.09 | 0.01 | 0.06 | 0.01 | 0.05 | 0.01 |
| Tetrahydro Linalool | 32 | — | — | 26.69 | — | 18.79 | — | 25 |
| Methyl nonyl acetaldehyde | — | 7 | 15 | — | 10 | — | 8.5 | — |
| Ethyl-2-methyl pentanoate | — | 1 | 1.5 | — | 1 | — | 1 | — |
| Iso E Super | — | 3 | 2 | — | 3 | — | 3 | — |
| Ionone beta | — | 1.5 | 2 | — | 1.5 | — | 1 | — |
| Habanolide | — | 3 | 3 | — | 3 | — | 3 | — |
| Geraniol | — | 15 | 12 | — | 10 | — | 11 | — |

Hydrotrope

The compositions of the present invention may preferably comprise a hydrotrope. Hydrotrope generally means a compound with the ability to increase the solubilities, preferably aqueous solubilities, of certain slightly soluble organic compounds, more preferably "hydrotrope" is defined as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.

2. Octanoic Acid is thereafter added to the solution in a proportion of 1.6 times the weight of the specific compound in solution, the solution being at a temperature of 20° C. The solution is mixed in a Sotax beaker with a stirrer with a marine propeller, the propeller being situated at about 5 mm above the bottom of the beaker, the mixer being set at a rotation speed of 200 rounds per minute.
3. The specific compound is hydrotrope if the the Octanoic Acid is completely solubilised, i.e., if the solution comprises only one phase, the phase being a liquid phase.

Preferred hydrotopes include the alkyl aryl sulphonates or alkyl aryl sulphonic acids. Preferred alkyl aryl sulphonates include: sodium, potassium, calcium and ammonium xylene sulphonates; sodium, potassium, calcium and ammonium toluene sulphonates; sodium, potassium, calcium and ammonium cumene sulphonates; sodium, potassium, calcium and ammonium substituted or unsubstituted naphthalene sulphonates; and mixtures thereof. Preferred alkyl aryl sulphonic acids include xylene sulphonic acid, toluene sulphonic acid, cumene sulphonic acid, substituted or unsubstituted naphthalene sulphonic acid and mixtures thereof. More preferably, cumene sulphonate or p-toluene sulphonate or mixtures thereof are used.

Viscosity Modifier

The present compositions may preferably comprise a viscosity modifier. Suitable viscosity modifiers include lower alkanols, ethylene glycol, propylene glycol, ethers, amines, and the like may be used in the present invention. Particularly preferred are the C1–C4 alkanols.

Suitable viscosity modifiers for use herein include ethers and diethers having from 4 to 14 carbon atoms, preferably from 6 to 12 carbon atoms, and more preferably from 8 to 10 carbon atoms. Also other suitable viscosity modifiers are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable alkoxylated alcohols which can be used herein are according to the formula $$R—(A)_n—R^1—OH$$

wherein R is H, a linear saturated or unsaturated alkyl of from 1 to 20 carbon atoms, preferably from 2 to 15 and more preferably from 2 to 10, wherein $R^1$ is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated alcohols to be used herein are methoxy octadecanol and/or ethoxyethoxyethanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R (A)n-OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable linear C1–C5 alcohols which can be used herein are according to the formula R—OH wherein R is a linear saturated or unsaturated alkyl group of from 1 to 5 carbon atoms, preferably from 2 to 4. Suitable linear $C_1$–$C_5$ alcohols are methanol, ethanol, propanol or mixtures thereof.

Other suitable viscosity modifiers include, but are not limited to, butyl diglycol ether (BDGE), butyltriglycol ether, ter amilic alcohol and glycerol. Particularly preferred viscosity modifiers which can be used herein are butoxy propoxy propanol, butyl diglycol ether, benzyl alcohol, butoxypropanol, propylene glycol, glycerol, ethanol, methanol, isopropanol and mixtures thereof.

Other suitable viscosity modifiers for use herein include propylene glycol derivatives such as n-butoxypropanol or n-butoxypropoxypropanol, water-soluble CARBITOL R viscosity modifiers or water-soluble CELLOSOLVE R viscosity modifiers; water-soluble CARBITOL R viscosity modifiers are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE R viscosity modifiers are compounds of the 2-alkoxyethoxy ethanol class, with 2-butoxyethoxyethanol being preferred. Other suitable viscosity modifiers include benzyl alcohol, and diols such as 2-ethyl-1, 3-hexanediol and 2,2,4-trimethyl-1,3-pentanediol and mixtures thereof. Some preferred viscosity modifiers for use herein are n-butoxypropoxypropanol, BUTYL CARBITOL Ò and mixtures thereof.

The viscosity modifiers can also be selected from the group of compounds comprising ether derivatives of mono-, di- and tri-ethylene glycol, butylene glycol ethers, and mixtures thereof. The molecular weights of these viscosity modifiers are preferably less than 350, more preferably between 100 and 300, even more preferably between 115 and 250. Examples of preferred viscosity modifiers include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred viscosity modifiers including mono- and di-ethylene glycol n-hexyl ether are available from the Union Carbide company.

When present the composition will preferably contain at least 0.01%, more preferably at least 0.5%, even more preferably still, at least 1% by weight of the composition of viscosity modifier. The composition will also preferably contain no more than 20%, more preferably no more than 10%.

These viscosity modifiers may be used in conjunction with an aqueous liquid carrier, such as water, or they may be used without any aqueous liquid carrier being present. Viscosity modifiers are broadly defined as compounds that are liquid at temperatures of 20° C.–25° C. and which are not considered to be surfactants. One of the distinguishing features is that viscosity modifiers tend to exist as discrete entities rather than as broad mixtures of compounds. Examples of preferred viscosity modifiers for the present invention include ethanol, propanol, isopropanol, 2-methyl pyrrolidinone, benzyl alcohol and morpholine n-oxide. Most preferred among these viscosity modifiers are ethanol and isopropanol.

Diamines

Another optional, although preferred, ingredient of the compositions according to the present invention is a diamine. In the context of a hand dishwashing composition, the "usage levels" of such diamine in the compositions herein can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least 0.1%, more preferably at least 0.2%, even more preferably, at least 0.25%, even more preferably still, at least 0.5% by weight of said composition of diamine. The composition will also preferably contain no more than 15%, more preferably no more than 10%, even more preferably, no more than 6%, even more preferably, no more than 5%, even more preferably still, no more than about 1.5% by weight of said composition of diamine.

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation.

Preferred organic diamines are those in which pK1 and pK2 are in the range of 8.0 to 11.5, preferably in the range of 8.4 to 11, even more preferably from 8.6 to 10.75. Preferred materials for performance and supply considerations are 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (Dytek EP) (pK1=10.5; pK2=8.9) 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

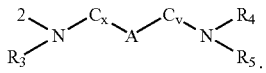

wherein $R_{2-5}$ are independently selected from H, methyl, —$CH_3CH_2$, and ethylene oxides; $C_x$ and $C_y$ are independently selected from methylene groups or branched alkyl groups where x+y is from 3 to 6; and A is optionally present and is selected from electron donating or withdrawing moieties chosen to adjust the diamine pKa's to the desired range. If A is present, then x and y must both be 1 or greater.

Examples of preferred diamines can be found in the copending provisional patent application of Phillip Kyle Vinson et al., entitled "Dishwashing Detergent Compositions Containing Organic Diamines for Improved Grease Cleaning, Sudsing, Low Temperature Stability and Dissolution", having P&G Case No. 7167P, application Ser. No. 60/087,693, and filed on Jun. 2, 1998, which is hereby incorporated by reference.

Carboxylic Acid

The compositions according to the present invention may comprise a linear or cyclic carboxylic acid or salt thereof. Where the acid or salt thereof is present and is linear, it preferably comprises from 1 to 6 carbon atoms whereas where the acid is cyclic, it preferably comprises greater than 3 carbon atoms. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms and mixtures thereof The carboxylic acids or salts thereof preferably have a pKa1 of less than 7, more preferably from 1 to 3. The carboxylic acid and salts thereof may comprise one or two or more carboxylic groups.

Suitable carboxylic acids or salts thereof are those having the general formula:

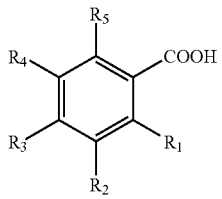

and/or

-continued

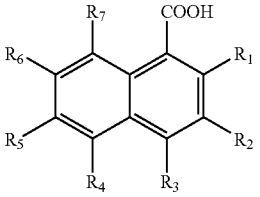

wherein $R_1$, $R_2$, $R_3$, $R_4$, $R_5$, $R_6$, $R_7$ are selected from the group consisting of alkyl chain having from 1 to 3 carbon atoms, hydroxy group, hydrogen, ester group, carboxylic acid group with the proviso that no more than 3 carboxylic acid groups are present.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof is preferably present at the level of from 0.1% to 5%, more preferably from 0.2% to 1% and most preferably from 0.25% to 0.5%.

Carboxylic acids can be used to provide improved rinse feel as defined below. The presence of anionic surfactants, especially when present in higher amounts in the region of 15–35% by weight of the composition, results in the composition imparting a slippery feel to the hands of the user and the dishware. This feeling of slipperiness is reduced when using the carboxylic acids as defined herein i.e., the rinse feel becomes draggy.

Surfactant

The compositions of the present invention preferably comprise a surfactant. Surfactants may be selected from the group consisting of amphoteric, zwitterionic, nonionic, anionic, cationic surfactants and mixtures thereof.

Amphoteric surfactants are preferred additional surfactants. The amphoteric surfactants useful in the present invention are preferably selected from amine oxide surfactants. Amine oxides are semi-polar nonionic surfactants and include water-soluble amine oxides containing one alkyl moiety of from 10 to 18 carbon atoms and 2 moieties selected from the group consisting of alkyl groups and hydroxyalkyl groups containing from 1 to 3 carbon atoms; water-soluble phosphine oxides containing one alkyl moiety of from 10 to 18 carbon atoms and 2 moieties selected from the group consisting of alkyl groups and hydroxyalkyl groups containing from 1 to 3 carbon atoms; and water-soluble sulfoxides containing one alkyl moiety of from 10 to 18 carbon atoms and a moiety selected from the group consisting of alkyl and hydroxyalkyl moieties of from 1 to 3 carbon atoms.

Semi-polar nonionic detergent surfactants include the amine oxide surfactants having the formula

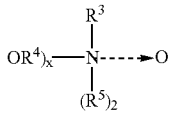

wherein $R^3$ is an alkyl, hydroxyalkyl, or alkyl phenyl group or mixtures thereof containing from 8 to 22 carbon atoms; $R^4$ is an alkylene or hydroxyalkylene group containing from 2 to 3 carbon atoms or mixtures thereof; x is from 0 to 3; and each $R^5$ is an alkyl or hydroxyalkyl group containing from 1 to 3 carbon atoms or a polyethylene oxide group containing from 1 to 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

Also suitable are amine oxides such as propyl amine oxides, represented by the formula:

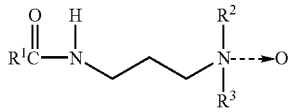

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl and n is from 0 to 10.

A further suitable species of amine oxide semi-polar surface active agents comprise compounds and mixtures of compounds having the formula:

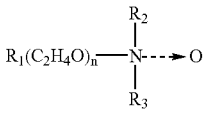

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl and n is from 0 to 10. Particularly preferred are amine oxides of the formula:

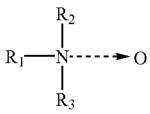

wherein $R_1$ is a $C_{10-14}$ alkyl and $R_2$ and $R_3$ are methyl or ethyl. Because they are low-foaming it may also be desirable to use long chain amine oxide surfactants which are more fully described in U.S. Pat. No. 4,316,824 (Pancheri), U.S. Pat. Nos. 5,075,501 and 5,071,594, incorporated herein by reference.

Other suitable, non-limiting examples of amphoteric detergent surfactants that are useful in the present invention include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

Further examples of suitable amphoteric surfactants are given in "Surface Active Agents and Detergents" (Vol. I and II by Schwartz, Perry and Berch), hereby incorporated by reference.

Preferably the amphoteric surfactant where present, is present in the composition in an effective amount, more preferably from 0.1% to 20%, even more preferably 0.1% to 15%, even more preferably still from 0.5% to 10%, by weight.

Suitable nonionic detergent surfactants are generally disclosed in U.S. Pat. No. 3,929,678, Laughlin et al., issued Dec. 30, 1975, at column 13, line 14 through column 16, line 6, incorporated herein by reference.

The condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from 2 to 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Fatty acid amide surfactants having the formula:

$$R^6\overset{\overset{\displaystyle O}{\|}}{C}N(R^7)_2$$

wherein $R^6$ is an alkyl group containing from 7 to 21 (preferably from 9 to 17) carbon atoms and each $R^7$ is selected from the group consisting of hydrogen, $C_1$–$C_4$ alkyl, $C_1$–$C_4$ hydroxyalkyl, and $—(C^2H_4O)_xH$ where x varies from 1 to 3.

Preferred amides are $C_8$–$C_{20}$ ammonia amides, monoethanolamides, diethanolamides, and isopropanolamides.

Preferably the nonionic surfactant, when present in the composition, is present in an effective amount, more preferably from 0.1% to 20%, even more preferably 0.1% to 15%, even more preferably still from 0.5% to 10%,by weight.

The detergent compositions hereof may also contain an effective amount of polyhydroxy fatty acid amide surfactant. By "effective amount" is meant that the formulator of the composition can select an amount of polyhydroxy fatty acid amide to be incorporated into the compositions that will improve the cleaning performance of the detergent composition. In general, for conventional levels, the incorporation of 1%, by weight, polyhydroxy fatty acid amide will enhance cleaning performance.

Where present, the detergent compositions may comprise 1% weight basis, polyhydroxy fatty acid amide surfactant, preferably from 3% to 30%, of the polyhydroxy fatty acid amide. The polyhydroxy fatty acid amide surfactant component comprises compounds of the structural formula:

$$R^2\overset{\overset{\displaystyle O}{\|}}{C}\underset{\underset{\displaystyle R^1}{|}}{N}$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

R' can be, for example, N-methyl, N-ethyl, N-propyl, N-isopropyl, N-butyl, N-2-hydroxy ethyl, or N-2-hydroxy propyl.

$R^2$-CO-N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Suitable anionic surfactants for use in the compositions herein include water-soluble salts or acids of the formula $ROSO_3M$ wherein R preferably is a $C_6$–$C_{20}$ linear or branched hydrocarbyl, preferably an alkyl or hydroxyalkyl having a $C_{10}$–$C_{20}$ alkyl component, more preferably a $C_{10}$–$C_{14}$ alkyl or hydroxyalkyl, and M is H or a cation, e.g., an alkali metal cation or ammonium or substituted ammonium, but preferably sodium.

Other suitable anionic surfactants for use herein are water-soluble salts or acids of the formula $RO(A)_mSO_3M$ wherein R is an unsubstituted linear or branched $C_6$–$C_{20}$ alkyl or hydroxyalkyl group having a $C_{10}$–$C_{20}$ alkyl component, preferably a $C_{12}$–$C_{20}$ alkyl or hydroxyalkyl, more preferably $C_{12}$–$C_{14}$ alkyl or hydroxyalkyl, A is an ethoxy or propoxy unit, m is greater than zero, typically between 0.5 and 5, more preferably between 0.5 and 2, and M is H or a cation which can be, for example, a metal cation, ammonium or substituted-ammonium cation. Alkyl ethoxylated sulfates as well as alkyl propoxylated sulfates are contemplated herein. Exemplary surfactants are $C_{10}$–$C_{14}$ alkyl polyethoxylate (1.0) sulfate, $C_{10}$–$C_{14}$ polyethoxylate (1.0) sulfate, $C_{10}$–$C_{14}$ alkyl polyethoxylate (2.25) sulfate, $C_{10}$–$C_{14}$ polyethoxylate (2.25) sulfate, $C_{10}$–$C_{14}$ alkyl polyethoxylate (3.0) sulfate, $C_{10}$–$C_{14}$ polyethoxylate (3.0) sulfate, and $C_{10}$–$C_{14}$ alkyl polyethoxylate (4.0) sulfate, $C_{10}$–$C_{18}$ polyethoxylate (4.0) sulfate. In a preferred embodiment the anionic surfactant is a mixture of alkoxylated, preferably ethoxylated and non-alkoxylated sulfate surfactants. In such a preferred embodiment the preferred average degree of alkoxylation is from 0.4 to 0.8.

Other particularly suitable anionic surfactants for use herein are alkyl sulphonates including water-soluble salts or acids of the formula $RSO_3M$ wherein R is a $C_6$–$C_{20}$ linear or branched, saturated or unsaturated alkyl group, preferably a $C_{10}$–$C_{20}$ alkyl group and more preferably a $C_{10}$–$C_{14}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_{12}$–$C_{16}$ alkyl group and more preferably a $C_{10}$–$C_{14}$ alkyl group, and M is H or a cation, e.g., an alkali metal cation (e.g., sodium, potassium, lithium, calcium, magnesium etc) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

In a further preferred embodiment the carbon chain of the anionic surfactant comprises alkyl, preferably C1–4 alkyl branching units. The average percentage branching of the anionic surfactant is greater than 30%, more preferably from 35% to 80% and most preferably from 40% to 60%. Such average percentage of branching can be achieved by formulating the composition with one or more anionic surfactants all of which are preferably greater than 30% branched, more preferably from 35% to 80% and most preferably from 40% to 60%. Alternatively and more preferably, the composition may comprise a combination of branched anionic surfactant and linear anionic surfactant such that on average the percentage of branching of the total anionic surfactant combination is greater than 30%, more preferably from 35% to 80% and most preferably from 40% to 60%.

The anionic surfactant is preferably present at a level of at least 10%, more preferably from 15% to 40% and most preferably from 20% to 35% by weight of the total composition.

Other additional anionic surfactants useful for detersive purposes can also be used herein. These can include salts (including, for example, sodium, potassium, ammonium, and substituted ammonium salts such as mono-, di- and triethanolamine salts) of soap, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14\text{-}16}$ methyl ester sulfonates; acyl glycerol sulfonates, fatty oleyl glycerol sulfates, alkyl phenol ethylene oxide ether sulfates, paraffin sulfonates, alkyl phosphates, sulphobetaines, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other particularly suitable anionic surfactants for use herein are alkyl carboxylates and alkyl alkoxycarboxylates having from 4 to 24 carbon atoms in the alkyl chain, preferably from 8 to 18 and more preferably from 8 to 16, wherein the alkoxy is propoxy and/or ethoxy and preferably is ethoxy at an alkoxylation degree of from 0.5 to 20, preferably from 5 to 15. Preferred alkylalkoxycarboxylate for use herein is sodium laureth 11 carboxylate (i.e., $RO(C_2H_4O)_{10}—CH_2COONa$, with R=C12–C14) commercially available under the name Akyposoft® 100NV from Kao Chemical Gbmh.

The particular surfactants used can therefore vary widely depending upon the particular end-use envisioned. Suitable additional surfactants are described in detail in the co-pending provisional patent application of Chandrika Kasturi et al., entitled "Liquid Detergent Compositions Comprising Polymeric Suds Enhancers", having P&G Case No. 6938P, application Ser. No. 60/066,344, incorporated above.

In a preferred aspect of the present invention, the composition comprises at least 30% surfactant, preferably selected from the group consisting of anionic, foaming nonionic, amphoteric and zwitterionic surfactants.

Polymeric Suds Stabilizer

The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

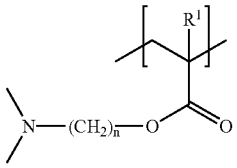

wherein each R is independently hydrogen, $C_1$–$C_8$ alkyl, and mixtures thereof, $R^1$ is hydrogen, $C_1$–$C_6$ alkyl, and mixtures thereof, n is from 2 to 6; and ii) copolymers of (i) and

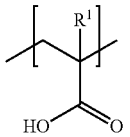

wherein $R^1$ is hydrogen, C1–C6 alkyl, and mixtures thereof, provided that the ratio of (ii) to (i) is from 2 to 1 to 1 to 2; The molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

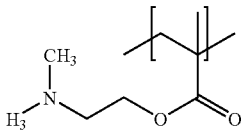

When present in the compositions, the polymeric suds booster may be present in the composition from 0.01% to 15%, preferably from 0.05% to 10%, more preferably from 0.1% to 5%, by weight.

Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from 0.0001% to 5% of active enzyme by weight of the detergent composition. Preferred proteolytic enzymes, then, are selected from the group consisting of Alcalase ® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Further non-limiting examples of suitable and preferred enzymes are disclosed in the copending application: "Dishwashing Detergent Compositions Containing Organic Diamines for Improved Grease Cleaning, Sudsing, Low temperature stability and Dissolution", having P & G Case No. 7167P and application Ser. No. 60/087,693, which is hereby incorporated by reference.

Because hydrogen peroxide and builders such as citric acid and citrates impair the stability of enzymes in LDL compositions, it is desirable to reduce or eliminate the levels of these compounds in compositions which contain enzymes. Hydrogen peroxide is often found as an impurity in surfactants and surfactant pastes. As such, the preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide.

Magnesium Ions

While it is preferred that divalent ions be omitted from LDL compositions prepared according to the present invention, alternate embodiments of the present invention may include magnesium ions.

It is desirable to exclude all divalent ions from the present LDL compositions, because such ions may lead to slower dissolution as well as poor rinsing, and poor low temperature stability properties. Moreover, formulating such divalent ion-containing compositions in alkaline pH matrices may be difficult due to the incompatibility of the divalent ions, particularly magnesium, with hydroxide ions.

Nonetheless, the presence of magnesium ions offers several benefits. Notably, the inclusion of such divalent ions improves the cleaning of greasy soils for various LDL compositions, in particular compositions containing alkyl ethoxy carboxylates and/or polyhydroxy fatty acid amide. This is especially true when the compositions are used in softened water that contains few divalent ions.

But in the present invention, these benefits can be obtained without the inclusion of divalent ions. In particular, improved grease cleaning can be achieved without divalent ions by the inclusion of organic diamines in combination with amphoteric and anionic surfactants in the specific ratios discussed above while enzymes have been shown to improve the skin mildness performance of the present LDL compositions.

If they are to be included in an alternate embodiment of the present LDL compositions, then the magnesium ions are present at an active level of from 0.01% to 1.5%, preferably from 0.015% to 1%, more preferably from 0.025% to 0.5%, by weight. The amount of magnesium ions present in compositions of the invention will be also dependent upon the amount of total surfactant present therein.

Preferably, the magnesium ions are added as a hydroxide, chloride, acetate, sulfate, formate, oxide or nitrate salt to the compositions of the present invention. Because during storage, the stability of these compositions becomes poor due to the formation of hydroxide precipitates in the presence of compositions containing moderate concentrations of hydroxide ions, it may be necessary to add certain chelating agents. Suitable chelating agents are discussed further below and in U.S. Pat. No. 5,739,092, issued Apr. 14, 1998, to Ofosu-asante, incorporated herein by reference.

Chelating Agents

The detergent compositions herein may also optionally contain one or more iron and/or manganese chelating agents. Such chelating agents can be selected from the group consisting of amino carboxylates, amino phosphonates, polyfunctional-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylene diamine tetracetates, N-hydroxy ethyl ethylene diamine triacetates, nitrilo-tri-acetates, ethylenediamine tetraproprionates, triethylene tetraamine hexacetates, diethylene triamine pentaacetates, and ethanol diglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylene diamine tetrakis (methylene phosphonates) as DEQUEST. Preferred, these amino phosphonates to not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from 0.00015% to 15% by weight of the detergent compositions herein. More preferably, if utilized, the chelating agents will comprise from 0.0003% to 3.0% by weight of such compositions.

A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from 0.001% to 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. Nos. 4,988,462; 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. Nos. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

Process of Cleaning Dishware

The present invention also relates to a process for cleaning dishware. Generally, we can describe processes of dishwashing as either full sink or direct application. In full sink application, the user fills a bowl or sink with water and adds the detergent composition. In this instance the detergent is added in the form of a water-soluble or water-dispersible pouch as described above.

To assess the time taken for the pouch to at least partially dissolve, the pouch is subjected to the below test. The PVA unit dose dishwashing detergent pouches, is placed in a 600 mL glass beaker filled with 500 mL of demineralised water at 48° C. A cylindrical magnetic stirrer (length 50 mm, diameter 8 mm) was added to the water and set to rotate at 200 rpm. The time is measured between placing the pouch into the water and the first moment of release of dishwashing composition. The above experiment is repeated 4 times. The pouch of the present invention should preferably at least partially dissolve in water, according to the above test method, in less than 60 seconds, more preferably less than 30 seconds, more preferably less than 20 seconds. In a preferred embodiment the pouch is used in combination with an applicator. The applicator may be squeezed at least once before contacting the dishware with the applicator. Squeezing the applicator comprising the unit dose detergent, more preferably the pouch, breaks or bursts the unit dose and improves the rate of release of the detergent into the applicator.

The applicator may be any suitable implement for applying detergent to a surface and washing dishware, as long as it comprises a cavity suitable for receiving the pouch. The applicator may be any such suitable applicator currently available on the market that has been adapted to comprise a cavity. Suitable applicators include a cloth, wipe, sheet, sponge, brush or mixtures thereof. More preferably the applicator is a sponge. By the term 'cavity' it is meant a hole, indent or generally carved-out space which provides an area suitable in size to hold the pouch. For example the cavity may be found on one exterior surface of the applicator. The cavity may be partially or completely covered by a cap arrangement to protect the pouch and keep it within the applicator. Alternatively the cavity may be found inside the applicator. In this latter embodiment the cavity may be accessed by a tube extending from an exterior surface into the interior cavity of the applicator. In this case, the exterior end of the tube may be partially or completely covered or closed. The exterior surface of the tube may be covered with a cap arrangement. Alternatively opposing sides of the tube may be brought together and secured, effectively closing the tube using any suitable material, for example Velcro (tradename). Closing or covering the exterior surface of the cavity of tube in this way protects the composition and keeps it within the applicator. The tube may be provided either may cutting away part of the applicator itself to make a tube or a separate tube in suitable material e.g., plastic, may be added to the applicator. Alternatively the applicator may consist of at least two sections which are at least partially separable from one another. The first section comprises the cavity and the second complimentary section may then be secured to the first section. The cavity may then be accessed by separating the at least two sections of the applicator to reveal the cavity. The sections may be partially separable, for example hinged or totally separable. Once the pouch has been placed in the cavity, the sections of the applicator can then be replaced and secured together. The sections can be secured by any suitable method known in the art, for example by a lock, interlocking or Velcro (tradename)-type system.

EXAMPLES

The examples provided below are in no way meant to be limiting. The pouches are made by placing one layer of polyvinyl alcohol (PVA) film, Monosol M8630 film of 76 micron, into a mould with preferably rounded corners (24 mm×24 mm). A vacuum is applied to deform the PVA film so that it takes the shape of the cavities. Heat is applied to the film to facilitate the deformation of the film. Whilst the vacuum is maintained, each cavity is filled with 5 ml of composition A–D listed below. A second layer of PVA film is then put on the mould and both PVA films are sealed onto each other to form the pouches. The average sealing conditions are 150° C. for 2 seconds. Finally, after releasing the vacuum, each pouch is individually cut by hand out of the net of 90 pouches. The perfumes listed below are selected form the perfume examples described earlier.

| INGREDIENT | A BLUE | B GREEN | C YELLOW | D RED |
|---|---|---|---|---|
| NaAE0.6 | 30.15 | 30.15 | 30.15 | 30.15 |
| Amine Oxide | 7.24 | 7.24 | 7.24 | 7.24 |
| Nonionic C10E8 | 3.36 | 3.36 | 3.36 | 3.36 |
| Bis(aminomethyl) cyclohexane | 0.55 | 0.55 | 0.55 | 0.55 |
| Polydimethylaminoethyl methacrylate | 0.22 | 0.22 | 0.22 | 0.22 |
| NaCl | 0.10 | 0.10 | 0.10 | 0.10 |
| Water | 14.76 | 14.76 | 14.76 | 14.76 |
| Propylene Glycol | 43.11 | 42.87 | 42.90 | 43.00 |
| Duasin Acid Blue AE liquid #9 from Clariant | 0.008 | 0.001 | | |
| Perfume A | 0.5 | | | |
| Duasin Acid Yellow SF liquid #23 From Clariant | | 0.05 | 0.025 | 0.001 |
| Perfume C | | 0.7 | | |
| Perfume B | | | 0.7 | |
| D&C Red liquid #23 from Warner & Jenkinson | | | | 0.015 |
| Perfume H | | | | 0.6 |

The 5 ml PVA unit dose dishwashing detergent pouches, above, were placed in a 600 mL glass beaker filled with 500 mL of demineralised water at 48° C. A cylindrical magnetic stirrer (length 50 mm, diameter 8 mm) was added to the water and set to rotate at 200 rpm. The time is measured between placing the pouch into the water and the first moment of release of dishwashing composition. The above experiment was repeated 4 times with each pouch A–D. The average time taken for the release of detergent was 22 seconds.

What is claimed is:

1. A kit for dishwashing, hard surface cleaning or laundry applications comprising at least a first and a second water-soluble or water-dispersible pouch containing at least a first and a second composition, respectively, wherein each pouch or composition contained therein provides a different visual effect, the first composition comprises a first perfume and the second composition comprises a second and different perfume and wherein at least one pouch comprises a film that is stretched, said film having a stretch degree from about 40% to about 500%.

2. A kit according to claim 1 comprising at least a first, a second and a third water-soluble or water-dispersible pouch containing at least a first, a second and a third composition, respectively, wherein the third composition comprises a third perfume which is different from said first and second perfumes.

3. A kit according to claim 1 wherein the pouch is made from materials selected from the group consisting of polymers, copolymers or derivatives thereof of polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides, and mixtures thereof.

4. A kit according to claim 3 wherein the pouch is made from materials selected from the group consisting of polyvinyl alcohol, starch, gelatine, natural gums, and mixtures thereof.

5. A kit according to claim 4 wherein the pouch is made from materials selected from the group consisting of polyvinyl alcohol, xanthum, carragum, and mixtures thereof.

6. A kit according to claim 1 wherein the pouch comprises two sheets of water-soluble, water-dispersible material sealed around the perimeter.

7. A kit according to claim 6 wherein the pouch is heat sealed.

8. A kit according to claim 1 wherein the pouch comprises less than 10 mL of composition.

9. A kit according to claim 1 comprising from 7 to 15 pouches, said kit comprised of mixtures of the first and second pouches.

10. A kit according to claim 1 wherein the first composition provides a first visual effect and the second composition provides a second and different visual effect.

11. A kit according to claim 1 wherein the first pouch provides a first visual effect and the second pouch provides a second and different visual effect.

12. A kit according to claim 1 wherein at least one composition comprises a component selected from surfactant, suds booster, pH adjusting agent, enzyme, solvent and mixtures thereof.

13. A kit for dishwashing, hard surface cleaning or laundry applications comprising at least a first, second, a third and a fourth water-soluble or water-dispersible pouch containing at least a first, a second, a third and a fourth composition, respectively, each pouch or composition comprised therein providing a different visual effect or comprising at least one different ingredient, wherein at least one pouch comprises a film that is stretched, said film having a stretch degree from about 40% to about 500%, wherein the first compositions comprises a first perfume and the second composition comprises a second and different perfume and where present the third and fourth compositions comprise a third and fourth perfume both of which being different from either the first and second perfumes.

14. A kit for dishwashing, hard surface cleaning or laundry applications comprising at least a first and a second individual water-soluble or water-dispersible pouch containing at least a first and a second composition, respectively, wherein each pouch or composition comprised therein provides a different visual effect or comprises at least one different ingredient, wherein at least one pouch comprises a film that is stretched, said film having a stretch degree from about 40% to about 500%, wherein at least one of said first and second composition comprises a blooming perfume composition comprising a blooming perfume ingredient having a boiling point of 250° C. or less and a ClogP of 3 or less, and wherein said at least one of said first and second composition comprises a blooming perfume composition comprising a second perfume ingredient having a boiling point of 250° C. or less and a ClogP of more than 3.2.

15. A process of cleaning dishware comprising the steps of:

a) selecting at least one pouch comprising a dishwashing composition from a kit comprising at least a first and a second water-soluble or water-dispersible pouch containing at least a first and a second composition, respectively, wherein each pouch or composition comprised therein providing a different visual effect or comprising at least one different ingredient, the first composition comprises a first perfume and the second composition comprises a second and different perfume, and wherein at least one pouch comprises a film that is stretched, said film having a stretch degree from about 40% to about 500%;

b) contacting the at least one pouch comprising a dishwashing composition with water; and c) contacting dishware with the water and dishwashing composition prepared in step b).

* * * * *